US005236796A

United States Patent [19]

Koyama et al.

[11] Patent Number: 5,236,796

[45] Date of Patent: Aug. 17, 1993

[54] ELECTROPHOTOGRAPHIC SENSITIVE MEDIUM

[75] Inventors: Takashi Koyama; Hideki Anayama, both of Kanagawa; Yuichi Hashimoto, Tokyo, all of Japan

[73] Assignee: Canon Kabushiki Kaisha, Tokyo, Japan

[21] Appl. No.: 593,865

[22] Filed: Oct. 5, 1990

[30] Foreign Application Priority Data

Oct. 6, 1989 [JP] Japan ..... 1-259981

[51] Int. Cl.[5] ..... G03G 5/14

[52] U.S. Cl. ..... 430/58; 430/62; 430/64

[58] Field of Search ..... 450/58, 60, 62, 64; 355/211; 358/300

[56] References Cited

U.S. PATENT DOCUMENTS

| | | | |
|---|---|---|---|
| 4,307,169 | 12/1981 | Matkan | 430/111 |
| 4,495,263 | 1/1985 | Vander Valk | 430/66 |
| 4,524,199 | 6/1985 | Lok et al. | 527/313 |
| 4,565,764 | 1/1986 | Nakahara et al. | 430/111 |
| 4,576,890 | 3/1986 | Hosoi | 430/137 |
| 4,626,489 | 12/1986 | Hyosu | 430/137 |
| 4,727,011 | 2/1988 | Mahabadi et al. | 430/138 |
| 4,775,605 | 10/1988 | Seki et al. | 430/63 |
| 4,830,943 | 5/1989 | Sasaki et al. | 430/74 |
| 4,871,635 | 10/1989 | Seki et al. | 430/60 |
| 4,954,406 | 9/1990 | Endo et al. | 430/62 |
| 4,988,597 | 1/1991 | Spiewak et al. | 430/62 |
| 5,071,723 | 10/1991 | Koyama et al. | 430/64 |

FOREIGN PATENT DOCUMENTS

| | | |
|---|---|---|
| 3700521 | 7/1987 | Fed. Rep. of Germany . |
| 3716975 | 11/1987 | Fed. Rep. of Germany . |
| WO85-00437 | 1/1985 | PCT Int'l Appl. . |

OTHER PUBLICATIONS

Patent Abstract of Japan, vol. 8, No. 109 [P-275] (1546), May 22, 1984.

*Primary Examiner*—John Goodrow

*Attorney, Agent, or Firm*—Fitzpatrick, Cella, Harper & Scinto

[57] ABSTRACT

An electrophotographic sensitive medium and apparatus for use with this medium. The electrophotographic sensitive medium has an electroconductive support, a sensitive layer, and an intermediate layer interposed between the support and the sensitive layer. The intermediate layer material contains a polyamide grafted with a polymer or a copolymer, and the polymer of copolymer contains a unit component represented by the following general formula:

wherein $R_1$ is a hydrogen atom or a methyl group, Z is —O— or —NH—, and A is an alkylene group having 1 to 6 carbon atoms.

9 Claims, 2 Drawing Sheets

ELECTROPHOTOGRAPHIC SENSITIVE MEDIUM

BACKGROUND OF THE INVENTION

1. Field of the Invention

This invention relates to electrophotographic sensitive mediums and, more particularly, to an electrophotographic sensitive medium having an improved intermediate layer provided between an electroconductive support and a sensitive layer and to various kinds of apparatus for use with this medium.

2. Description of the Prior Art

Ordinarily, to maintain a certain image density and to prevent occurrence of fogging when an image is formed by using a Carlson type electrophotographic sensitive medium after repeatedly electrically charging and exposing the medium, it is important to improve the stability of a dark portion potential and a light portion potential.

Some techniques have, therefore, been proposed which relate to improvements in the performance of injection of charge from the support into the sensitive layer, in adhesion between the support and the sensitive layer, in application of the material for forming the sensitive layer, and in providing an intermediate layer between the support and the sensitive layer to cover defects on the support.

A type of electrophotographic sensitive medium has also been proposed which has a laminated structure in which the functions of the sensitive layer are distributed to a charge generation layer and a charge transport layer. Ordinarily, the charge generation layer has a very small thickness of, for example, about 0.5 μm. There is, therefore, a possibility of a considerable reduction in the uniformity of the thickness of the charge generation layer due to defects, contaminations, scratches or the like on the support surface, or foreign materials attached to the surface.

Non-uniformity of the thickness of the charge generation layer makes the sensitivity of the sensitive medium uneven. It is therefore desirable to maximize the degree of uniformity of the charge generation layer.

For these reasons, the provision of an intermediate layer has been proposed. The intermediate layer is to be formed between the charge generation layer and the support and is to have the functions of a barrier layer and a bonding layer while covering defects on the support.

The following materials are known as a material for forming the layer formed between the sensitive layer and the support: polyamide (Japanese Patent Laid-Open Nos. 48-47344 and 52-25638), polyester (Japanese Patent Laid-Open Nos. 52-20836 and 54-26738), polyurethane (Japanese Patent Laid-Open Nos. 49-10044 and 53-89435), casein (Japanese Patent Laid-Open No. 55-103556), polypeptide (Japanese Patent Laid-Open No. 53-48523), polyvinyl alcohol (Japanese Patent Laid-Open No. 52-100240), polyvinyl pyrrolidone (Japanese Patent Laid-Open No. 48-30936), vinyl acetate-ethylene copolymer (Japanese Patent Laid-Open No. 48-26141), maleic anhydride ester polymer (Japanese Patent Laid-Open No. 52-10138), polyvinylbutyral (Japanese Patent Laid-Open Nos. 57-90639 and 58-106549), tetra ammonium salt containing polymer (Japanese Patent Laid-Open Nos. 51-126149 and 56-60448), ethyl cellulose (Japanese Patent Laid-Open No. 55-143564), and the like.

However, for electrophotographic sensitive mediums using the above-mentioned materials as the intermediate layer, it is difficult to obtain potential characteristics and image qualities stable over wide environmental conditions from a low-temperature/low-humidity condition to a high-temperature/high-humidity condition, because the resistance of the intermediate layer varies with the changes in temperature/humidity.

For example, if the sensitive medium is repeatedly used under a low-temperature/low-humidity condition which increases the resistance of the intermediate layer, a substantial amount of charge remains in the intermediate layer to increase the light portion potential and the residual potential, resulting in a copied image that is fogged. If this sensitive medium is used under the same condition with an electrophotographic printer which effects reversal development, the image density is reduced or the copies obtained are not uniform in image qualities.

In addition, in a high-temperature/high-humidity condition, the barrier function deteriorates due to a reduction in the resistance of the intermediate layer, and the rate of carrier injection from the support is thereby increased, resulting in a reduction in the dark portion potential.

In a high-temperature/high-humidity condition, therefore, the density of the copied image is reduced and, if the sensitive medium is used in an electrophotographic printer which effects reversal development, the copied image tends to be damaged by black-spot defects and fogging.

SUMMARY OF THE INVENTION

It is an object of the present invention to provide an electrophotographic sensitive medium having stable potential characteristics and capable of forming uniform images over a wide range of environmental conditions from a low-temperature/low-humidity condition to a high-temperature/high-humidity condition.

It is another object of the present invention to provide an electrophotographic sensitive medium having an intermediate layer capable of sufficiently covering defects on the support to form a good image free of any defect.

It is still another object of the present invention to provide an apparatus unit, an electrophotographic apparatus and a facsimile apparatus in which an electrophotographic sensitive medium capable of forming uniform images over a wide range of environmental conditions is used.

To achieve these objects, the present invention provides an electrophotographic sensitive medium having an electroconductive support, a sensitive layer formed over the support, and an intermediate layer interposed between the support and the sensitive layer, wherein the intermediate layer contains a polyamide grafted with a polymer or a copolymer side chain, which contains a unit component represented by the following general formula (I):

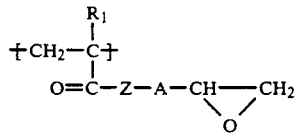

(I)

wherein $R_1$ is a hydrogen atom or a methyl group, Z is —O— or —NH—, and A is an alkylene group having 1 to 6 carbon atoms.

The electrophotographic sensitive medium in accordance with the present invention has a particular grafted polyamide contained in the intermediate layer between the support and the sensitive layer, and is therefore effective in obtaining stable potential characteristics and good images over a wide range of environmental conditions from a low-temperature/low-humidity condition to a high-temperature/high-humidity condition.

The above and other objects, features and advantages of the present invention will be made more apparent by the following description with reference to the accompanying drawings.

DESCRIPTION OF THE PREFERRED EMBODIMENTS

Figure 1:
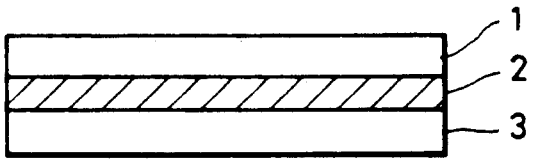
FIG. 1 is an illustration of an example of the layered structure of an electrophotographic sensitive medium according to the present invention.

Examples of a polyamide forming the principal skeletal chain of the grafted polyamide used for the present invention are nylons, such as nylon 6, nylon 11, nylon 12, nylon 6,6 and nylon 6,10, copolymerized nylons containing the above-mentioned components, N-alkoxymethylated nylon, N-alkylated nylon, and nylons containing aromatic components.

A component forming the graft side chain may be a polymer having the unit component represented by general formula (I), or may be a copolymer of this unit component and some other copolymerizable compound.

When the polyamide is grafted with a copolymer, the content of the unit component represented by the formula (I) in the graft side chain is, preferably, at least 50 mole percent or, more preferably, at least 70 mole percent.

The grafted polyamide in accordance with the present invention may be used after being subjected to cross-linking reaction. Crosslinking reduces the solubility of the polyamide which is important when a coating solution of sensitive material for application to the intermediate layer is formed.

Ordinarily, cross-linking is effected by reaction of an epoxy group on the graft chain in a heating process after formation of the sensitive layer. It is also possible to effect cross-linking by adding some other epoxy compound or melamine compound if necessary.

When N-alkoxymethylated nylon is used as a polyamide component, it is possible to effect cross-linking by self-crosslinking of the alkoxyl group with heating and an acid catalyst such as citric acid, adipic acid, tartaic acid, maleic acid, or hypophosphorous acid.

The following are examples of the polyamide portion forming the principal chain.

EXAMPLES OF POLYAMIDE PRINCIPAL CHAIN COMPONENT

| | Name of resin | Weight average molecular weight |
|---|---|---|
| (I) | Nylon | 105,000 |
| (II) | copolymerized nylon 6,6-6,6-10<br>Composition ratio: 6/6-6/6-10 = 1/1/1 | 180,000 |
| (III) | copolymerized nylon 6,12,6-6,6-10<br>Composition ratio: 6/12/6-6/6-10 = 2/1/2/2 | 140,000 |
| (IV) | N-methoxymethylated nylon 6<br>Methoxymethyl substitution rate: 28 mol % | 260,000 |

Examples of the grafted polyamide in accordance with the present invention are shown below.

Resin Example (1)

Principal chain: polyamide component example (I)
Side chain: graft portion component

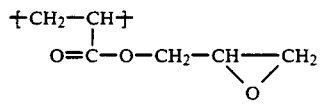

Graft portion content: 42 wt%

Resin Example (2)

Principal chain: polyamide component example (II)
Side chain: graft portion component same as above
Graft portion content: 35 wt %

Resin Example (3)

Principal chain: polyamide component example (III)
Side chain: graft portion component same as above
Graft portion content; 17 wt %

Resin Example (4)

Principal chain: polyamide component example (IV)
Side chain: graft portion component same as above
Graft portion content: 32 wt %

Resin Example (5)

Principal chain: polyamide component example (I)
Side chain: graft portion component

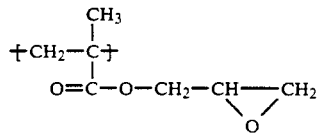

Graft portion content: 31 wt %

Resin Example (6)

Principal chain: polyamide component example (II)
Side chain: graft portion component same as above
Graft portion content: 25 wt %

Resin Example (7)

Principal chain: polyamide component example (III)
Side chain: graft portion component same as above
Graft portion content: 27 wt %

Resin Example (8)

Principal chain: polyamide component example (IV)
Side chain: graft portion component same as above
Graft portion content: 32 wt %

Resin Example (9)

Principal chain: polyamide component example (I)
Side chain: graft portion component

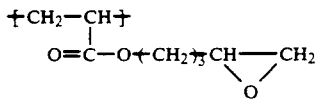

Graft portion content: 19 wt %

Resin Example (10)

Principal chain: polyamide component example (II)
Side chain: graft portion component same as above
Graft portion content: 23 wt %

Resin Example (11)

Principal chain: polyamide component example (III)
Side chain: graft portion component same as above
Graft portion content: 20 wt %

Resin Example (12)

Principal chain: polyamide component example (IV)
Side chain: graft portion component same as above
Graft portion content: 16 wt %

Resin Example (13)

Principal chain: polyamide component example (I)
Side chain: graft portion component

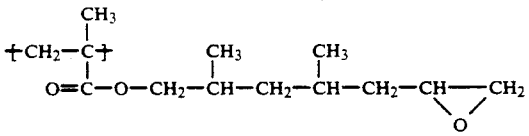

Graft portion content: 23 wt %

Resin Example (14)

Principal chain: polyamide component example (II)
Side chain: graft portion component same as above
Graft portion content: 30 wt %

Resin Example (15)

Principal chain: polyamide component example (III)
Side chain: graft portion component same as above
Graft portion content: 29 wt %

Resin Example (16)

Principal chain: polyamide component example (IV)
Side chain: graft portion component same as above
Graft portion content: 17 wt %

Resin Example (17)

Principal chain: polyamide component example (I)
Side chain: graft portion component

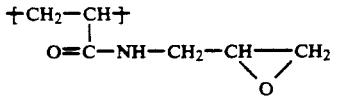

Graft portion content: 13 wt %

Resin Example (18)

Principal chain: polyamide component example (II)
Side chain: graft portion component same as above
Graft portion content: 22 wt %

Resin Example (19)

Principal chain: polyamide component example (III)
Side chain: graft portion component same as above
Graft portion content: 21 wt %

Resin Example (20)

Principal chain: polyamide component example (IV)
Side chain: graft portion component same as above
Graft portion content: 21 wt %

Resin Example (21)

Principal chain: polyamide component example (I)
Side chain: graft portion component

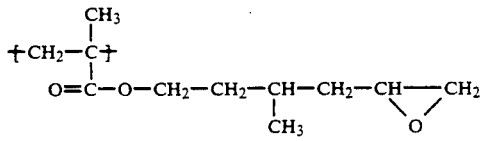

Graft portion content; 28 wt %

Resin Example (22)

Principal chain: polyamide component example (II)
Side chain: graft portion component same as above
Graft portion content: 25 wt %

Resin Example (23)

Principal chain: polyamide component example (III)
Side chain: graft portion component same as above
Graft portion content: 22 wt %

Resin Example (24)

Principal chain: polyamide component example (IV)
Side chain: graft portion component same as above
Graft portion content: 25 wt %

Resin Example (25)

Principal chain: polyamide component example (I)
Side chain: graft portion component

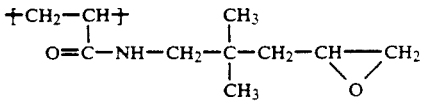

Graft portion content: 14 wt %

Resin Example (26)

Principal chain: polyamide component example (II)
Side chain: graft portion component same as above
Graft portion content: 18 wt %

Resin Example (27)

Principal chain: polyamide component example (III)
Side chain: graft portion component

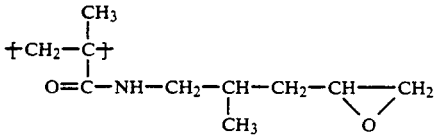

Graft portion content: 21 wt %

Resin Example (28)

Principal chain: polyamide component example (IV)
Side chain: graft portion component same as above
Graft portion content: 33 wt %

Resin Example (29)

Principal chain: polyamide component example (I)
Side chain: graft portion component

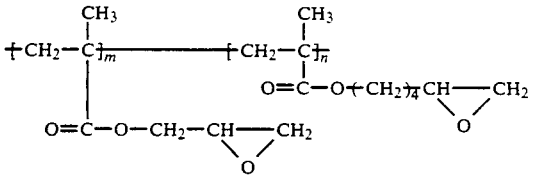

m:n = 5:5 (molar ratio)

Graft portion content: 34 wt %

Resin Example (30)

Principal chain: polyamide component example (III)
Side chain: graft portion component same as above
Graft portion content: 30 wt %

Resin Example (31)

Principal chain: polyamide component example (II)
Side chain: graft portion component

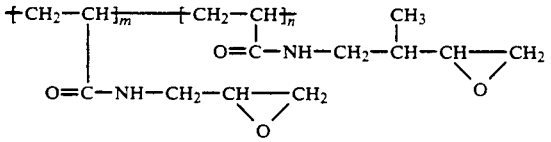

m:n = 5:5 (molar ratio)

Graft portion content 15 wt %

Resin Example (32)

Principal chain: polyamide component example (IV)
Side chain: graft portion component same as above
Graft portion content: 27 wt %

Resin Example (33)

Principal chain: polyamide component example (III)
Side chain: graft portion component

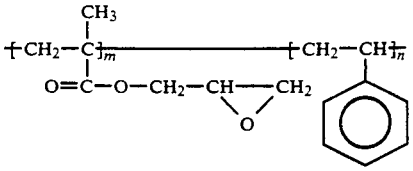

m:n = 8:2 (molar ratio)

Graft portion content: 32 wt %

Resin Example (34)

Principal chain: polyamide component example (IV)
Side chain: graft portion component same as above
Graft portion content: 34 wt %

Resin Example (35)

Principal chain: polyamide component example (III)
Side chain: graft portion component

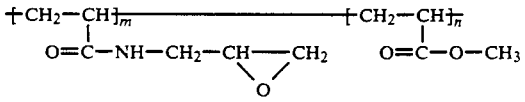

m:n = 7:3 (molar ratio)

Graft portion content: 17 wt %

Resin Example (36)

Principal chain: polyamide component example (IV)
Side chain: graft portion component same as above
Graft portion content: 23 wt %

Resin Example (37)

Principal chain: polyamide component example (III)
Side chain: graft portion component

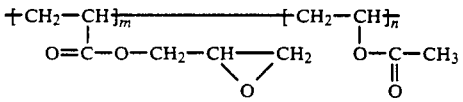

m:n = 5:5 (molar ratio)

Graft portion content: 25 wt %

Resin Example (38)

Principal chain: polyamide component example (IV)
Side chain: graft portion component same as above
Graft portion content: 22 wt %

In the electrophotographic sensitive medium of the present invention, the above-described type grafted polyamide is contained in the intermediate layer to achieve the objects of the present invention.

That is, changes in the characteristics of the medium due to environmental changes, including an increase in the residual potential under a low-temperature/low-humidity condition and a reduction in the dark portion potential due to deterioration of the barrier function under a high-temperature/high-humidity condition, can be prevented by using the grafted polyamide for the intermediate layer.

The volume resistivity of the grafted polyamides according to the present invention is not substantially changed in response to environmental changes to a low-temperature/low-humidity condition or a high-temperature/high-humidity condition. It is therefore possible to obtain an electrophotographic sensitive medium that exhibits highly stable characteristics over wide environmental changes, if the intermediate layer contains the grafted polyamide resin according to the present invention.

The resistance of ordinary polyamides may be reduced by a factor of three with an environmental change from an ordinary temperature/ordinary humidity condition to a high-temperature/high-humidity condition. In contrast, the change in the resistance of grafted polyamides is very small.

The reason for the improved stability of grafted polyamides against environmental changes is not clear. However, the following effects due to structural factors may be attributed.

(1) Attachment of a graft chain promotes the formation of an amorphous network structure from a linear polymer, when the sensitive coating layer is formed, and thereby facilitates retention of conductive substances such as water or ions.

(2) Polar groups on the graft portions promote adsorption of water and ionic substances.

It is considered that the resistance is not increased even in a low-temperature/low-humidity condition because of these effects, and that the resistance is not reduced abruptly even in a high-temperature/high-humidity condition because the amorphous network structure prevents water molecules and the like from being excessively absorbed into the coating.

The grafted polyamide in accordance with the present invention is formed by grafting, through a polymeric reaction, a monomer corresponding to the unit component represented by the general formula (I) with the principal chain polyamide.

The kind of principal chain polyamide is not specifically limited. However, it is known that the degree of activity of the methyle group or the methylene group adjacent to the nitrogen atom of the amide bond is ordinarily high enough to promote radical formation, so that the graft chain grows from this portion.

It is therefore preferable for the polyamide used for the present invention to have a proton on the carbon atom on the principal chain adjacent to the nitrogen atom of the amide bonding.

To effect a polymeric reaction for grafting, a polyamide for the principal chain and a monomer provided as a graft component are dissolved in a suitable solvent capable of dissolving both the polyamide and the monomer, and a radical polymerization initiator, such as azobisisobutyronitrile (AIBN) or benzoyl peroxide, or an ionic polymerization initiator, such as a metallic sodium is added to the solution. A grafted polyamide is thereby produced.

In most cases, some impurity such as a monomer initiator residue remains in the grafted polyamide after formation. It is therefore preferable to effect refining by reprecipitation or washing.

PRODUCTION EXAMPLE (OF RESINE EXAMPLE (7))

11.4 g of copolymerized nylon 6,12,6-6,6-10 (weight composition ratio: 6/12/6-6/6-10=2/1/2/2, weight average molecular weight: 140,000), 3.8 g of glycidyl methacrylate, 0.0002 g of AIBN were dissolved in 150 g of methanol, and the solution was agitated at 40° C. four 4 hours, thereby effecting grafting reaction.

Next, the reacting mixture solution was diluted with 150 g of methanol, and the diluted solution was dropped in a mixture solvent of 2.2 kg of methyl ethyl ketone (MEK) and 1.1 kg of n-hexane, thereby obtaining a white precipitate of the grafted polyamide. This precipitate was filtered, was extracted after being washed three times with 500 g of MEK on a filter paper, and was decompress-dried at 25° C. for 6 hours, thereby obtaining 14.1 g of the desired Example Resin (7).

The intermediate layer in accordance with the present invention may be formed of the above-described grafted polyamide alone or formed of a system of the same grafted polyamide to which some other resin, additive, and electroconductive material are added as desired.

Examples of the resin which can be added to the intermediate layer material include polyamide, such as a copolymerized nylon or N-alkoxymethylated nylon, polyester, polyurethane, polyurea, or phenolic resin.

Examples of the additive are fine particles of titanium oxide, alumina and silicone resin, a surfactant, a silicone leveling agent, a silane coupling agent, a titanate coupling agent, and the like.

Examples of the electroconductive material are metallic powder, flaky fine metallic particles and metallic monofilaments of aluminum, copper, nickel and silver, electroconductive metallic oxides, such as antimony oxide, indium oxide and stannic oxide, high polymer electroconductive materials, such as polypyrrole, polyaniline and high polymer electrolytes, carbon fiber, carbon black, graphite powder, organic and inorganic electrolytes, and electroconductive powders having particle surfaces coated with these electroconductive materials.

The thickness of the intermediate layer is selected by considering the electrophotographic characteristics and any defects on the support. The thickness generally ranges from about 0.5 to about 0.1 to 50 μm. It ordinarily ranges from 5 μm or and preferably from about 1 to 30 μm if an electroconductive material is added.

The material of the intermediate layer can be applied by dip coating, spray coating, roll coating or the like.

FIG. 1 shows the layered structure of the electrophotographic sensitive medium according to the present invention with the above-mentioned intermediate layer interposed between a sensitive layer 1 and the support 3.

Figure 2:
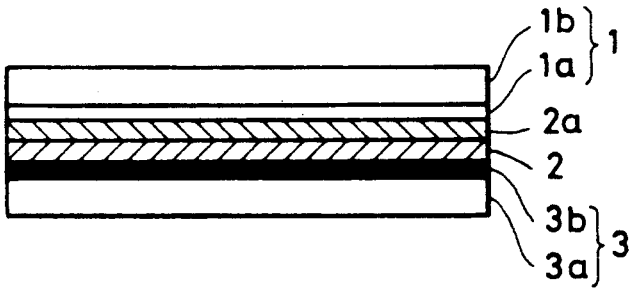
FIG. 2 is an illustration of another example of the layered structure of the electrophotographic sensitive medium according to the present invention.

FIG. 2 shows that, according to the present invention, a second intermediate layer 2a whose main component is a resin can be formed on the first intermediate layer 2 if it is necessary to control, for example, the barrier performance.

Examples of the resin material for the second intermediate layer are polyamide, polyester, polyurethane, polyurea, or phenolic resin.

The thickness of the second intermediate layer is preferably between about 0.1 to 5 μm. The second intermediate layer is formed in the same manner as the first intermediate layer.

FIG. 2 further shows that the sensitive layer of the electrophotographic sensitive medium of the present invention may be a single layer type or a laminated type having discrete layer functions; namely, a charge generation layer 1*a* and a charge transport layer 1*b*. In particular, an organic sensitive layer having discrete layer functions is preferred.

The charge generation layer can be formed by dispersing a charge generating material in a binding agent and applying the dispersion liquid on the intermediate layer. Examples of such generating material are an azo pigment, such as Sudan Red or Dian Blue, a quinone pigment, such as pyrenequinone or anthantrone, a quinocyanine pigment, a perylene pigment, an indigo pigment, such as, indigo or thioindigo, an azulenium salt pigment, or a phthalocyanine pigment, such as copper phthalocyanine or titanyl oxophthalocyanine. Examples of the binding agent are polyvinyl butyral, polystyrene, polyvinyl acetate, acrylic resin, polyvinyl pyrrolidone, ethyl cellulose, or cellulose acetate butyrate.

The thickness of the charge generation layer is about 5 μm or smaller, preferably, between about 0.05 to 2 μm.

The charge transport layer is formed by using a coating liquid which is prepared by dissolving a charge transporting material in a resin having a film forming property. Examples of the charge transporting material are polycyclic aromatic compound having biphenylene, anthracene, pyrene or phenanthrene for the principal or side chain, a nitrogen containing cyclic compound, such as indole, carbazole, oxadiazole or pyrazoline, a hydrazone compound, or a styryl compound.

The reason for forming the layer in this manner is that the charge transport material is ordinarily a low molecular weight compound and has poor film forming properties.

Examples of a resin having a suitable film forming property are polyester, polycarbonate, polymethacrylic acid ester or polystyrene.

The thickness of the charge transport layer is between about 5 to 40 μm, preferably, between about 10 to 30 μm.

According to the present invention, the sensitive layer can also be a layer of an organic photoconductive polymer such as polyvinylcarbazole, polyvinylanthracene, selenium deposited layer, selenium-tellurium deposited layer or an amorphous silicon layer.

The support of the electrophotographic sensitive medium of the present invention may be of any material so long it is electroconductive. For example, the support is a drum or a sheet of a metal such as aluminum, copper, chromium, nickel, zinc, stainless steel or the like; a member formed by laminating a metallic foil of aluminum or copper on a plastic film; a member formed by vacuum-depositing aluminum, indium oxide, tin oxide or the like on a plastic film; or a sheet of a metal, plastic or paper coated with an electroconductive material applied alone or with a suitable binding agent resin to form an electroconductive layer.

FIG. 2 shows an embodiment wherein the support has an electroconductive layer 3*b* coated on a support base 3*a*.

Examples of the electroconductive material used for the electroconductive layer are fine metallic particles, metallic foil or metallic monofilaments of aluminum, copper, nickel, silver or the like, an electroconductive metallic oxide, such as antimony oxide, indium oxide or stannic oxide, a high polymer electroconductive material, such as polypyrrole, polyaniline or a high polymer electrolyte, carbon fiber, carbon black, graphite powder, an organic and inorganic electrolyte, and an electroconductive powder having its particle surfaces coated with the above-mentioned electroconductive material.

Examples of the binding agent resin used for the electroconductive layer are a thermoplastic resin, such as polyamide, polyester, acrylic resin, polyamino ester, polyvinyl acetate, polycarbonate, polyvinylformal, polyvinyl butyral, polyvinylalkyl ether, polyalkylene ether or polyurethane elastomer, or a thermosetting resin, such as thermosetting polyurethane, phenolic resin or epoxy resin.

The mixture ratio of the electroconductive material and the binding agent resin is about 5:1 to 1:5. This mixture ratio is determined after due consideration of the resistance, surface properties, and coating fitness and the like on of the electroconductive layer.

When the electroconductive material is a powder, the mixture material is prepared by an ordinary method using a ball mill, roll mill, sand mill or the like.

Some other additive can be mixed which may be a surfactant, a silane coupling agent, a titanate coupling agent, silicone oil, or a silicone leveling agent.

The electrophotographic sensitive medium of the present invention can be applied to ordinary electrophotographic apparatus such as copiers, laser beam printers, LED printers and liquid crystal shutter type printers. It can also be applied to other various kinds of apparatus including those for display, recording, light printing, stereotype process, facsimile to which electrophotographic technology is applied.

Figure 3:
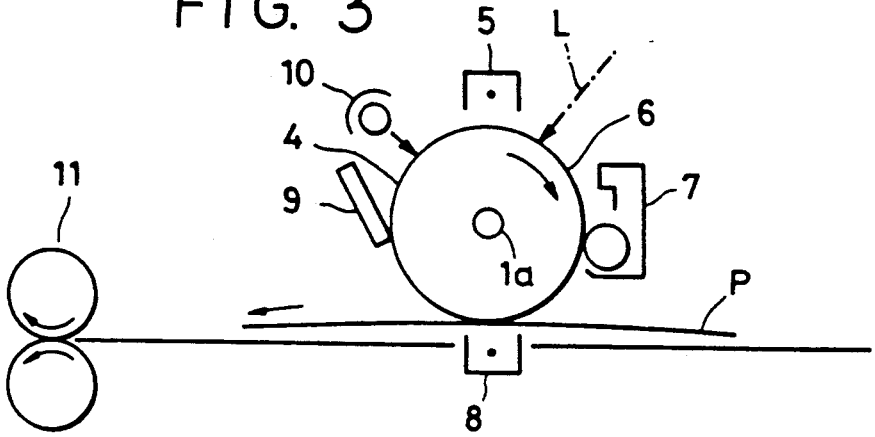
FIG. 3 is a schematic diagram of the construction of an ordinary transfer type electrophotographic apparatus in which an electrophotographic sensitive medium in accordance with the present invention is used.

FIG. 3 schematically shows the construction of an ordinary transfer type electrophotographic apparatus in which a drum type sensitive medium is used.

The electrophotographic apparatus has a drum type sensitive medium 4 provided as an image carrying member which is driven to rotate on a shaft 1*a* at a predetermined peripheral speed in the direction of the arrow. A peripheral surface of the sensitive medium 4 is uniformly charged by an electrical charging means 5 at a predetermined positive or negative potential during the rotation of the medium, and is thereafter subjected to light image exposure L (slit exposure or laser beam scanning exposure) at an exposure section 6 by an image exposure means (not shown). A static latent image corresponding to the exposed image is thereby successively formed on the peripheral surface of the sensitive medium.

Then the static latent image is developed by a development means 7 to form a developed toner image. The developed toner image is successively transferred to a transfer sheet P which is supplied to a gap between the sensitive medium 4 and a transfer means 8 from a sheet supply section (not shown) in synchronization with the rotation of the sensitive medium 4.

The transfer sheet P to which the image is transferred is separated from the sensitive medium surface, led to an image fixation section 11 to fix the image, and thereafter outputted as a copy outside the apparatus.

The surface of the sensitive medium 4 is cleaned by a cleaning means 9 which removes transfer residue toner, and discharged by a pre-exposure means 10, and thereafter repeatedly used for image forming.

Ordinarily, a corona electrical charging device is used as the means 5 for uniformly charging the sensitive medium 4, and a corona transfer device is used as the transfer means 8. Some of the components of the electrophotographic apparatus including the sensitive medium, the development means and the cleaning means may be integrally combined as a single unit which is detachable from the main apparatus body. For example, at least one of the charging means, the development means and the cleaning means may be combined integrally with the sensitive medium to form a single unit which can be detached from and attached to the main apparatus body. The detachable structure may include a guide means such as rails provided on the apparatus body. In such as structure, the charging means and/or the development means may be provided on the above-mentioned single unit.

When the electrophotographic apparatus is used as a copier or a printer, the light image exposure L is effected by using a light reflected by, or transmitted through, an original or by laser beam scanning or driving an LED array or a liquid crystal shutter array in accordance with a signal converted from read image data.

Figure 4:
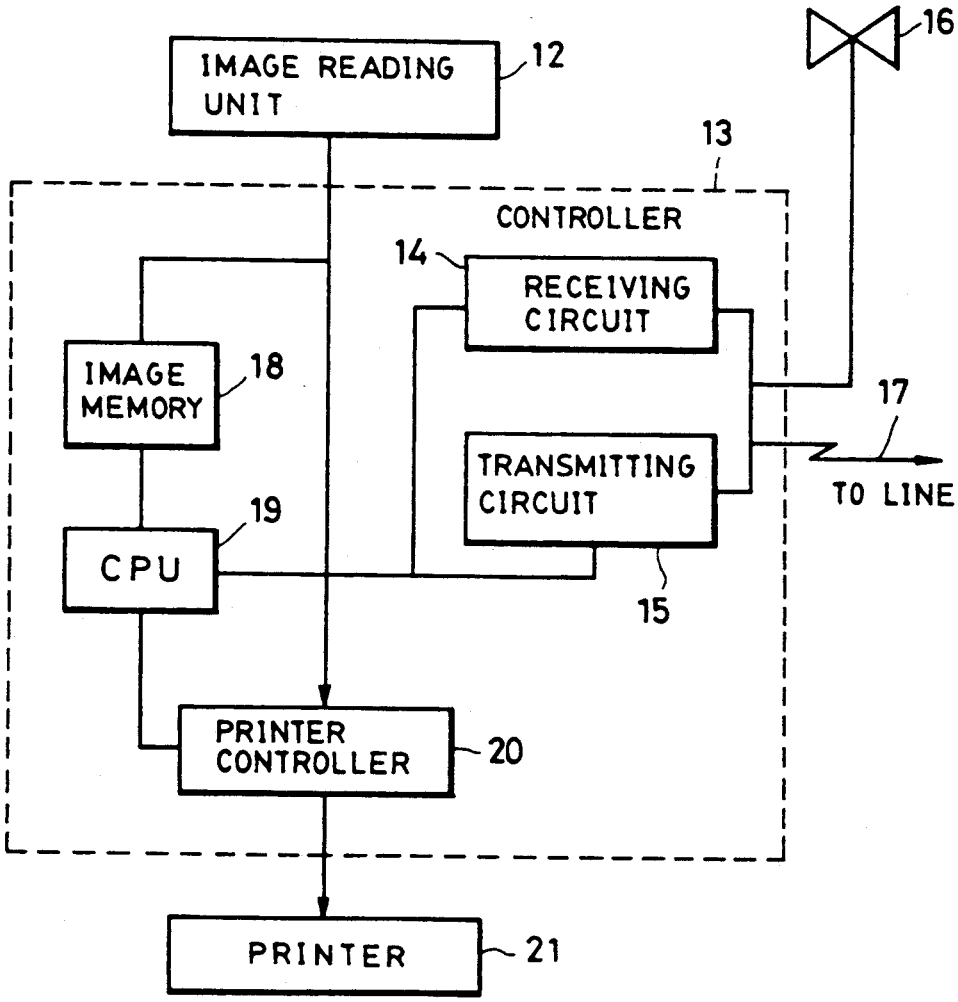
FIG. 4 is a block diagram of a facsimile apparatus in which an electrophotographic unit is used with an electrophotographic sensitive medium in accordance with the present invention.

When the electrophotographic apparatus is used as a facsimile printer, the light image exposure L is controlled in accordance with data received by the facsimile so that the received data is printed. FIG. 4 is a block diagram of such a facsimile apparatus.

A controller 13 operates image reading unit 12 and printer 21. The overall control of the controller 13 is effected by a CPU 19. Read data supplied from the image reading unit is transmitted to a distant terminal through a transmitting circuit 15. Data received from the terminal is sent to the printer 21 through receiving circuit 14. Image data in a predetermined format is stored in image memory 18. Printer controller 20 controls the printer 21. Telephone set 16 is also Connected to the controller 13.

An image received from line 17, i.e., image information from the remote terminal connected through the line, is demodulated by the receiving circuit 14 and is decoded by the CPU 19, and the decoded data is successively stored in the image memory 18. After storage of data in an amount corresponding to at least one page in the memory 18, the image on the corresponding page is recorded. The CPU 19 reads the one-page image information from the memory 18 and sends the decoded one-page image information to the printer controller 20. When the printer controller 20 receives the one-page image information from the CPU 19, it controls the printer 21 to effect image information printing of the corresponding page.

The CPU 19 conducts receiving of the image information of the next page while the image on the present page is being printed by the printer 21. Receiving-/recording of images are thus effected.

The following Examples represent certain preferred embodiments of the present invention.

EXAMPLE 1

50 parts of electroconductive titanium oxide powder having tin oxide coating containing 10% antimony oxide, 25 parts of a phenolic resin, 20 parts of methyl cellosolve, 5 parts of methanol and 0.002 parts of a silicone oil (polydimethylsiloxane polyoxyalkylene copolymer having an average molecular weight of 3,000) were diffused by using a sand mill with 1 mm glass beads for 2 hours to prepare an electroconductive layer coating material.

This coating material was applied by dipping on an aluminum cylinder (having a diameter of 30 mm and a length of 260 mm) and was dried at 140° C. for 30 minutes, thereby forming an electroconductive layer having a thickness of 20

Next, 5 parts of resin example (2) were dissolved in 95 parts of methanol to prepare an intermediate layer coating material.

This coating material was applied by dipping on the electroconductive layer and was dried at 10° C. for 20 minutes, thereby forming an intermediate layer having a thickness of 0.6 μm.

Next, 3 parts of a disazo pigment represented by a structural formula:

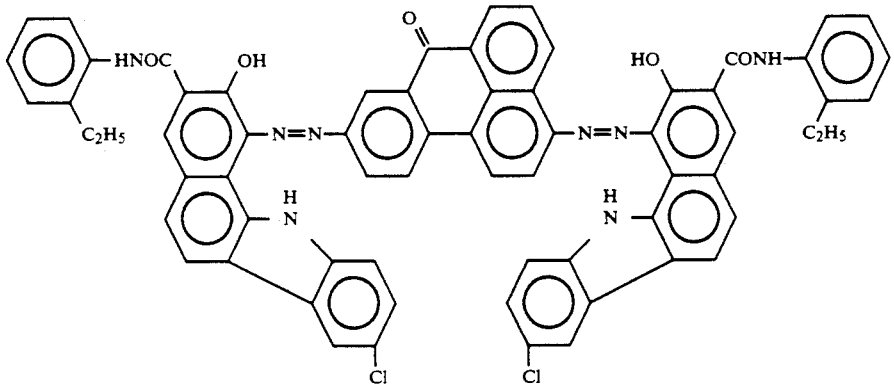

,2 parts of polyvinylbenzal (benzal rate: 80%, average molecular weight: 11,000) and 35 parts of cyclohexane were diffused by using a sand mill with 1 mm glass beads for 12 hours and 60 parts of MEK was thereafter added to prepare a charge generation layer coating liquid.

This coating liquid was applied by dipping on the intermediate layer and was dried at 80° C. for 20 minutes, thereby forming a charge generation layer having a thickness of 0.2 μm.

Next, 10 parts of a styryl compound represented by the structural formula:

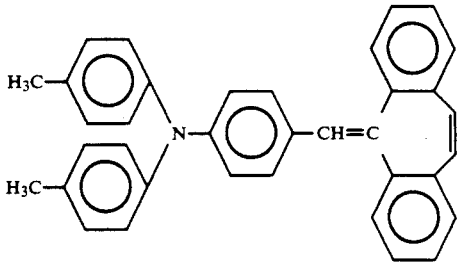

and 10 parts of polycarbonate (weight average molecular weight: 46,000) were dissolved in a solvent formed of a mixture of 20 parts of dichloromethane and 40 parts of chlorobenzene, and this solution was applied by dipping on the charge generation layer and was dried at 120° C. for 60 minutes, thereby forming a charge transport layer having a thickness of 18 μm.

The electrophotographic sensitive medium manufactured in this manner was tested in a reversal development type laser beam printer which repeats a charging-exposure-development-transfer-cleaning process in 1.5 sec cycles, and was used under an ordinary-temperature/ordinary-humidity condition (23° C., 50% RH) and under a high-temperature/high-humidity condition (30° C., 85% RH) with the amount of exposure adjusted to 1.7 $\mu J/cm^2$ to evaluate electrophotographic characteristics.

The results of this evaluation, as shown in Table 1, show that the difference between the dark portion potential ($V_D$) and the light portion potential ($V_L$) was large and a sufficient degree Of potential Contrast was obtained. Also, the dark portion potential was stable even under the high-temperature/high-humidity condition, and the obtained image had good qualities and was free of any black-spot defect and fogging.

EXAMPLES 2 to 5

Electrophotographic sensitive mediums were manufactured in the same manner as Example 1 except that Resin Examples (7), (10), (26) and (31) were respectively used in place of Resin Example (2) as the intermediate layer coating materials.

These electrophotographic sensitive mediums were evaluated in the same manner as Example 1. In all these examples as shown in Table 1, the dark portion potential was stable even under the high-temperature/high-humidity condition, and the obtained image had good qualities and was free of any black-spot defect and fogging.

COMPARATIVE EXAMPLE 1

An electrophotographic sensitive medium was manufactured in the same manner as Example 1 except that N-methoxymethylated nylon 6 (weight average molecular weight: 150,000, methoxymethyl group substitution rate: 28%) was used as an intermediate layer coating material.

This electrophotographic sensitive medium was evaluated in the same manner as Example 1. The results, as shown in Table 1, show that under the high-temperature/high-humidity condition, the charging performance deteriorated, the dark portion potential decreased and many black-spot defects occurred on the image.

TABLE 1

| | 23° C. $V_D$ (−V) | 50% RH $V_L$ (−V) | 30° C. $V_D$ (−V) | 80% RH Image |
|---|---|---|---|---|
| Example 1 | 685 | 160 | 680 | good |

TABLE 1-continued

| | 23° C. $V_D$ (−V) | 50% RH $V_L$ (−V) | 30° C. $V_D$ (−V) | 80% RH Image |
|---|---|---|---|---|
| Example 2 | 670 | 165 | 670 | good |
| Example 3 | 665 | 170 | 660 | good |
| Example 4 | 665 | 175 | 665 | good |
| Example 5 | 675 | 180 | 670 | good |
| Comparative Example 1 | 670 | 170 | 620 | black spots |

EXAMPLE 6

5 parts of Resin Example (8) was dissolved in 95 parts of methanol to prepare an intermediate layer coating material.

This coating material was applied by dipping on an aluminum cylinder (having a diameter of 30 mm and a length of 360 mm) and was dried at 100° C. for 15 minutes, thereby forming an intermediate layer having a thickness of 1.2 μm.

Next, 4 parts of a disazo pigment represented by the structural formula:

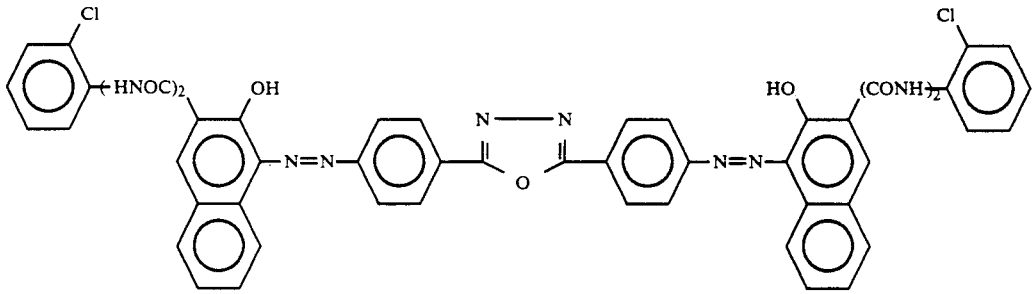

, 2 parts of polyvinylbutyral (butyral rate: 68%, average molecular weight: 24,000) and 34 parts of cyclohexane were diffused by using a sand mill with 1 mm glass beads for 12 hours and 60 parts of tetrahydrofuran (THF) was thereafter added to prepare a charge generation layer coating liquid.

This coating liquid was applied by dipping on the intermediate layer and was dried at 80° C. for 15 minutes, thereby forming a charge generation layer having a thickness of 0.15 μm.

Next, 10 parts of a styryl compound used in Example 1 and 10 parts of polycarbonate (weight average molecular weight: 63,000) were dissolved in a solvent formed of a mixture of 15 parts of dichloromethane and 45 parts of chlorobenzene, and this solution was applied by dipping on the charge generation layer and was dried at 120° C. for 60 minutes, thereby forming a charge transport layer having a thickness of 25 μm.

The electrophotographic sensitive medium manufactured in this manner was set in a copier which repeats a charging-exposure (exposure rate: 2.2 lux.sec)-development-transfer-cleaning process in 0.6 sec cycles.

The electrophotographic characteristics of this electrophotographic sensitive medium were evaluated under a low-temperature/low-humidity condition (15° C., 15%RH). The results of this evaluation, as shown in Table 2, show that the difference between the dark portion potential ($V_D$) and the light portion potential ($V_L$) was large and a sufficient degree of potential contrast was obtained.

Further, the medium was tested by continuously printing 1000 copies and the results show no substantial increase in the light portion potential and the copies obtained have significantly improved stability.

EXAMPLES 7 to 10

Electrophotographic sensitive mediums were manufactured in the same manner as Example 6 except that Resin Examples (15), (21), (27) and (30) were respectively used in place of Resin Example (8) as the intermediate layer coating materials.

These electrophotographic sensitive mediums were evaluated in the same manner as Example 6. In all these Examples, the difference between the dark portion potential ($V_D$) and the light portion potential ($V_L$) was large and a sufficient degree of potential contrast was obtained. After continuous printing of 1000 copies, substantially no increase in the light portion potential was observed, and the copies were obtained with significantly improved stability. The results are shown in Table 2.

COMPARATIVE EXAMPLE 2

An electrophotographic sensitive medium was manufactured in the same manner as Example 6 except that alcohol-soluble copolymerized nylon (weight average molecular weight: 78,000) was used as an intermediate layer coating material, and was evaluated in the same manner as Example 6. The results, as shown in Table 2, show that the light portion potential was increased and fogging occurred on the image after continuously printing 1000 copies.

COMPARATIVE EXAMPLE 3

An electrophotographic sensitive medium was manufactured in the same manner as Example 6 except that polyglycidyl methacrylate (weight average molecular weight: 85,000) was used as an intermediate layer coating material, and was evaluated in the same manner as Example 6. The results, as shown in Table 2, show that the light portion potential was increased and fogging occurred on the image after continuously printing 1000 copies.

TABLE 2

| | Initial stage | | After continuous printing of 1000 copies | |
|---|---|---|---|---|
| | $V_D$ (−V) | $V_L$ (−V) | $V_L$ (−V) | Image |
| Example 6 | 675 | 195 | 205 | good |
| Example 7 | 650 | 190 | 195 | good |
| Example 8 | 655 | 200 | 210 | good |
| Example 9 | 660 | 205 | 215 | good |
| Example 10 | 650 | 200 | 215 | good |
| Comparative Example 2 | 660 | 220 | 390 | fogging |
| Comparative Example 3 | | | | |

EXAMPLE 11

30 parts of electroconductive titanium oxide powder having a tin oxide coating containing 10% antimony oxide, 20 parts of rutile type titanium oxide, 20 parts of Resin Example (20), 20 parts of methanol, 10 parts of 2-propanol were diffused by using a sand mill with 1 mm glass beads for 1 hour to prepare an electroconductive layer coating material.

This coating material was applied by dipping on an aluminum cylinder (having a diameter of 60 mm and a length of 260 mm) and was dried at 160° C. for 30 minutes, thereby forming an intermediate layer having a thickness of 16 μm.

Next, 5 parts of alcohol-soluble copolymerized nylon (weight average molecular weight: 75,000) were dissolved in 95 parts of methanol, applied by dipping on the intermediate layer, dried at 80° C. for 10 minutes, thereby forming a second intermediate layer.

Next, 2 parts of a disazo pigment represented by the structural formula:

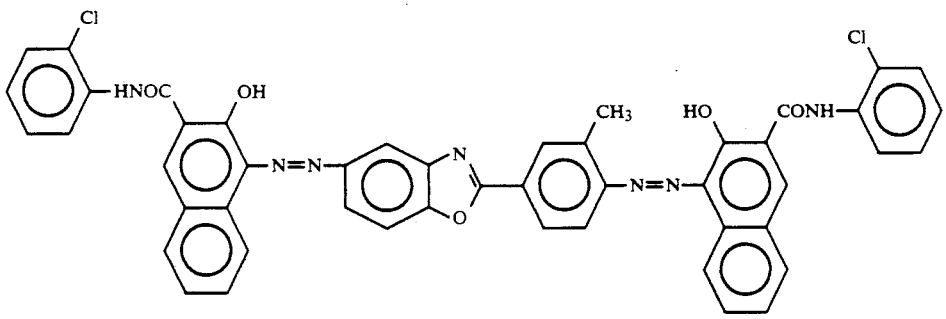

,1of polyvinylbutyral (butyral rate: 72%, average molecular weight: 18,000) and 30 parts of cyclohexane were diffused by using a sand mill with 1 mm glass beads for 20 hours, and 65 parts of MEK was thereafter added to prepare a charge generation layer coating liquid.

This coating liquid was applied by dipping on the second intermediate layer and was dried at 80° C. for 20 minutes, thereby forming a charge generation layer having a thickness of 0.2 μm.

Next, 10 parts of a hydrazone compound represented by the structural formula:

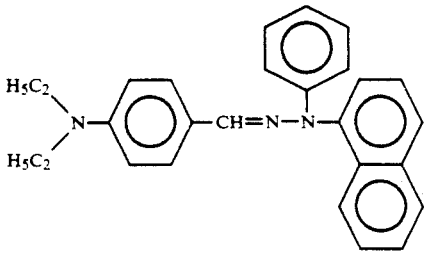

and 10 parts of polycarbonate (weight average molecular weight: 46,000) were dissolved in a solvent formed of a mixture of 20 parts of dichloromethane and 40 parts of chlorobenzene, and the solution obtained was applied by dipping on the charge generation layer and was dried at 120° C. for 60 minutes, thereby forming a charge transport layer having a thickness of 23 μm.

The electrophotographic sensitive medium manufactured in this manner was tested in a copier which repeats a charging-exposure (exposure rate: 2.8 lux sec)-development-charging-exposure-transfer-cleaning process in 0.8 sec cycles.

The electrophotographic characteristics of this electrophotographic sensitive medium were evaluated under a low-temperature/low-humidity condition (10° C., 10% RH). The results of this evaluation, as shown in Table 3, show that the difference between the dark portion potential ($V_D$) and the light portion potential ($V_L$) was large and a sufficient degree of potential contrast was obtained.

Further, the medium was tested by continuously printing 1000 copies. The results show substantially no increase in the light portion potential and the copies obtained have significantly improved stability.

EXAMPLE 12

An electrophotographic sensitive medium was manufactured by forming an intermediate layer, a charge generation layer and a charge transport layer in the same manner as Example 11 except that no second intermediate layer was formed.

This electrophotographic sensitive medium obtained was evaluated in the same manner as Example 11. The results show that the difference between the dark portion potential ($V_D$) and the light portion potential ($V_L$) was large and a sufficient degree of potential contrast was obtained.

Further, the medium was tested by continuously printing 1000 copies. The results show substantially no increase in the light portion potential and the copies obtained have significantly improved stability. The results are shown in Table 3.

COMPARATIVE EXAMPLES 4 AND 5

Electrophotographic sensitive mediums corresponding to Examples 11 and 12 were manufactured in the same manner as Examples 11 and 12 except that a phenolic resin was used as the resin for the intermediate layer coating material containing electroconductive titanium oxide powder and rutile type titanium oxide powder.

The electrophotographic sensitive mediums obtained were evaluated in the same manner as Example 11. The results, as shown in Table 3, show that in Comparative Example 4, the light portion potential was increased and fogging occurred on the image after continuously printing 1000 copies.

As for Comparative Example 5 in which the charge generation layer and the charge transport layer were directly formed o the intermediate layer, the barrier effect of the intermediate layer was insufficient, the rate of charge injection from the support was high and the dark portion potential was low, resulting in the failure to obtain a potential contrast necessary for image formation.

TABLE 3

| | Second-intermediate layer | Initial stage $V_D$ (−V) | Initial stage $V_L$ (−V) | After continuous printing of 1000 copies $V_L$ (−V) | After continuous printing of 1000 copies Image |
|---|---|---|---|---|---|
| Example 11 | one | 665 | 190 | 195 | good |
| Example 12 | none | 670 | 200 | 210 | good |
| Comparative Example 4 | one | 660 | 190 | 285 | fogging |
| Comparative Example 5 | none | 305 | 110 | (beyond evaluation) | |

EXAMPLES 13 AND 14

Electrophotographic sensitive mediums were manufactured in the same manner as Example 1 except that Resin Examples (34) and (35) were respectively used in place of Resin Example (2) as the intermediate layer coating materials.

The electrophotographic sensitive mediums obtained were evaluated in the same manner as Example 1. In all the Examples, the dark portion potential was stable even under the high-temperature/high-humidity condition, and the obtained image had good qualities and was free of any black-spot defect and fogging. The results are shown in Table 4.

COMPARATIVE EXAMPLE 6

An electrophotographic sensitive medium was manufactured in the same manner as Example 1 except that N-methoxymethylated nylon 6 (polyamide component example (IV)) was used as the principal chain polyamide for the intermediate layer coating material, and that a resin prepared by grafting a copolymer having the following structure was also used for the coating material.

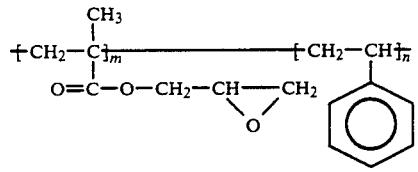

m:n = 2.8 (molar ratio)
graft portion content: 31 wt %

The electrophotographic sensitive medium obtained was evaluated in the same manner as Example 1. The results, as shown in Table 4, show that under the high-temperature/high-humidity condition, the electrification performance was deteriorated, the dark portion potential was reduced and man black-spot defects occurred on the image.

TABLE 4

| | 23° C. $V_D$ (−V) | 50% RH $V_L$ (−V) | 30° C. $V_D$ (−V) | 80% RH Image |
|---|---|---|---|---|
| Example 13 | 680 | 200 | 680 | good |
| Example 14 | 680 | 195 | 675 | good |
| Comparative Example 6 | 675 | 190 | 605 | black spots |

What is claimed is:

1. An electrophotographic sensitive medium having an electroconductive support, a sensitive layer, and an intermediate layer interposed between said support and said sensitive layer, wherein said intermediate layer contains a polyamide grafted with a polymer or a copolymer side chain, said polymer or copolymer containing a unit component represented by the following general formula (I):

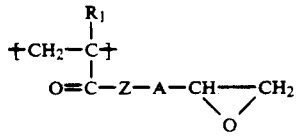

(I)

wherein $R_1$ is a hydrogen atom or a methyl group, Z is —O— or —NH—, and A is an alkylene group having 1 to 6 carbon atoms.

2. An electrophotographic sensitive medium according to claim 1, wherein the polyaide of said grafted polyamide includes at least one nylon selected the group consisting of nylon 6, nylon 11, nylon 12, nylon 6,6 and nylon 6,10, N-alkoxymethylated nylon, N-alkylated nylon, and nylons containing aromatic components.

3. An electrophotographic sensitive medium according to claim 1, wherein $R_1$ is a methyl group and Z is —O—.

4. An electrophotographic sensitive medium according to claim 2, wherein $R_1$ is a methyl and Z is —O—.

5. An electrophotographic sensitive medium according to claim 1, wherein if the polyamide is grafted with a copolymer side chain, the content of said unit component represented by the general formula (I) in the graft side chain is 50 mol % or larger.

6. An electrophotographic sensitive medium according to claim 1, wherein said sensitive layer comprises a laminated organic sensitive layer having a charge generation layer and a charge transport layer.

7. An electrophotographic sensitive medium according to claim 3, wherein said sensitive layer comprises a laminated organic sensitive layer having two layers, and wherein the layer adjacent to the intermediate layer is a charge generation layer and the other is a charge transport layer.

8. An electrophotographic sensitive medium according to claim 1, wherein said electroconductive support comprises a support base and an electroconductive layer provided on said support base, and wherein said electroconductive layer contains an electroconductive material.

9. An electrophotographic sensitive medium according to claim 1, wherein said intermediate layer contains an electroconductive material and wherein a second intermediate layer comprising a resin is provided between said intermediate layer and said sensitive layer.

* * * * *

UNITED STATES PATENT AND TRADEMARK OFFICE

CERTIFICATE OF CORRECTION

PATENT NO. : 5,236,796

DATED : August 17, 1993

INVENTOR(S) : TAKASHI KOYAMA, ET AL.

It is certified that error appears in the above-identified patent and that said Letters Patent is hereby corrected as shown below:

COLUMN 9

Line 39, "methyle" should read --methyl--.
Line 60, "RESINE" should read --RESIN--.
Line 67, "four" should read --for--.

COLUMN 10

Line 38, "about 0.5 to" should be deleted.
Line 39, "from 5 μm or and" should read --from about 0.5 to 5 or and--.

COLUMN 12

Line 9, "on" should be deleted.
Line 22, "facsimile" should read --and facsimile--.

COLUMN 13

Line 42, "Connected" should read --connected--.

COLUMN 14

Line 11, "20" should read --20 μm.--.

COLUMN 15

Line 16, "Of" should read --of-- and "Contrast" should read --contrast--.

COLUMN 18

Line 45, ",1of" should read --, 1 part of--.

UNITED STATES PATENT AND TRADEMARK OFFICE

CERTIFICATE OF CORRECTION

PATENT NO. : 5,236,796

DATED : August 17, 1993

INVENTOR(S) : TAKASHI KOYAMA, ET AL.

It is certified that error appears in the above-identified patent and that said Letters Patent is hereby corrected as shown below:

COLUMN 19

Line 11, "charging-exposure-" should be deleted.

COLUMN 20

Line 55, "man" should read --many--.

COLUMN 21

Line 20, "polyaide" should read --polyamide--.
Line 21, "selected" should read --selected from--.

COLUMN 22

Line 2, "methyl" should read --methyl group--.

Signed and Sealed this

Nineteenth Day of April, 1994

Bruce Lehman

*Attest:*

BRUCE LEHMAN

*Attesting Officer*

*Commissioner of Patents and Trademarks*

--